US005774098A

United States Patent [19]

Kawashima et al.

[11] Patent Number: 5,774,098

[45] Date of Patent: Jun. 30, 1998

[54] INDICATOR

[75] Inventors: Toshiyuki Kawashima, Kanagawa; Minoru Tanaka; Hiroshi Honjo, both of Tokyo; Masaru Fujii, Kanagawa, all of Japan

[73] Assignee: Sony Corporation, Japan

[21] Appl. No.: 61,557

[22] Filed: May 17, 1993

[30] Foreign Application Priority Data

May 22, 1992 [JP] Japan ..... 4-155998

[51] Int. Cl.[6] ..... G09G 3/32

[52] U.S. Cl. ..... 345/83

[58] Field of Search ..... 345/1, 3, 83, 82, 345/204, 102; 368/67

[56] References Cited

U.S. PATENT DOCUMENTS

| | | | |
|---|---|---|---|
| 4,185,283 | 1/1980 | Clark | 345/204 |
| 4,271,408 | 6/1981 | Teshima et al. | 345/83 |
| 4,912,688 | 3/1990 | Syfert | 368/67 |
| 4,975,694 | 12/1990 | McLaughlin et al. | 345/102 |
| 5,121,112 | 6/1992 | Nakadozono | 345/1 |

*Primary Examiner*—Curtis Kuntz
*Assistant Examiner*—Vivian Chang
*Attorney, Agent, or Firm*—Ronald P. Kananen

[57] ABSTRACT

An indicator lamp unit comprises a number of light-emitting elements, such as LEDs, arranged on the circumference of a disk or arranged in rows on the circumference of a cylinder, and a milk-white lamp case covering the light-emitting elements. A display terminal comprises, in an integral unit, a display, such as a LCD or an ELD, and said indicator lamp unit. The display and an internal CPU are controlled by an external CPU.

18 Claims, 14 Drawing Sheets

INDICATOR

BACKGROUND OF THE INVENTION

1. Field of the Invention

The present invention relates to an indicator which integrates a signal light and a display unit.

2. Description of the Prior Art

A conventional signal lamp comprises light-emitting elements and an envelop which covers the light-emitting elements and is the same color as the light-emitting elements. The brightness, or luminance, of the signal lamp changes according to whether the light-emitting elements are emitting light or not, thus transmitting to the exterior information regarding changes in the condition of an associated apparatus. Also, conventionally, a signal lamp only, or a display only, is provided, or if both are provided, they are providing separately.

Since the above-mentioned conventional signal lamp transmits information by changing its luminance, reflections of ambient light make it difficult to see, depending on where it is situated. Also, in the case of indicators including a lamination of stacked signal lamps each having a different color, there are problems regarding restrictions on where they can be installed, and the increased amount and complexity of wiring.

An indicator comprising only signal lamps, as in convention indicators, has the problem of being unable to display detailed information instantly. An indicator comprising only a display unit has the disadvantage of being unable to display information so that the information can be seen from a distance or from a position beside or behind the display unit. An indicator comprising a signal lamp and a display unit which are provided separately does not allow the information to be seen at a glance, necessitates installation at two or more positions, requires a large amount of complex wiring, and does not allow simultaneous high-speed control of both the signal lamp and display unit.

SUMMARY OF THE INVENTION

In light of this situation, an object of the present invention is to provide a signal lamp capable of displaying information in manner which is easily discernable.

Another object of the present invention is to provide an indicator capable of displaying the operating condition of the associated apparatus and detailed information simultaneously in one place.

A further object of the present invention is to provide an indicator comprising a signal lamp and a display unit which allows simultaneous high-speed control of the signal lamp and display unit.

The indicator of a first aspect of this invention is characterized by a signal lamp comprising color light-emitting elements, such as light-emitting diodes (hereinafter abbreviated to "LEDs"), and a milk-white or transparent envelope, such as a lamp case.

Since the color light-emitting elements are covered by the milk-white or transparent lamp case, the lamp case of the signal lamp looks milk-white or the same color as that of the light-emitting elements when none of the light-emitting elements is turned on. When a light-emitting element is turned on, colored light emitted by the light-emitting element is externally emitted through the lamp case. Since the color of the lamp case changes when the light-emitting element is turned on, the visibility of the lamp case is not impaired by the reflection of ambient light from the surface of the lamp case.

The indicator of a second aspect of the present invention is characterized by the integration of a signal lamp and a display unit.

Having the signal lamp unit and the display integrated into the indicator in the second aspect of the present invention allows it to display both an operating condition of an associated apparatus and detailed information, in one place.

The indicator according to a third aspect of the present invention comprises a main case, a display unit located in the main case, a first control device for processing signals to control a signal lamp, and a second control device for controlling the display unit and the first control device, located separately from the main case.

Having a first control device for controlling the signal lamp unit, and the second control device for controlling the first control device and the display unit, the indicator of the third aspect of the present invention allows both the signal lamp and the display to be controlled simultaneously at high speed.

The indicator according to a fourth aspect of the present invention comprises a main case, a signal lamp located in the main case, a display unit located in the main case, a first control device for controlling both the signal lamp and the display unit, and located in the main case, and a second control device, for controlling the first control device, located separately from the main case.

Having a first control device for controlling the signal lamp and the display unit, and a second control device for controlling the first control device, the indicator of the fourth aspect of the present invention allows both the signal lamp and the display unit to be controlled simultaneously at high speed.

The indicator of a fifth aspect of the present invention comprises a main case, a signal lamp located in the main case, a display unit located in the main case, and a control device for controlling the signal lamp and the display unit, located separately from the main case.

Having the control device for controlling the signal lamp and the display unit, the indicator in the fifth aspect of the present invention allows simultaneous high-speed control of both the signal lamp and the display unit.

BRIEF DESCRIPTION OF THE DRAWINGS

The above other objects, features and advantages of the present invention will become more apparent from the following description and accompanying drawings, in which:

FIG. 2 is a perspective view of the signal lamp turned on;

DETAILED DESCRIPTION OF THE PREFERRED EMBODIMENTS

Figure 1:
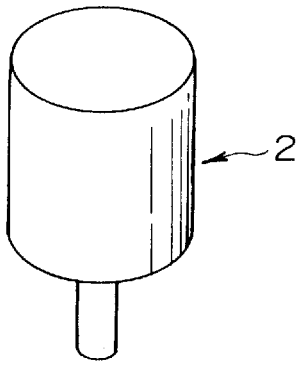
FIG. 1 is a perspective view of a signal lamp according to a first embodiment of the present invention, with the indicator lamp unit off.
Figure 2:
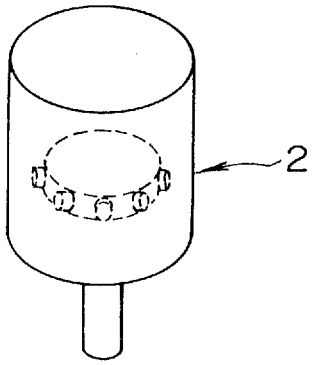
Figure 3:
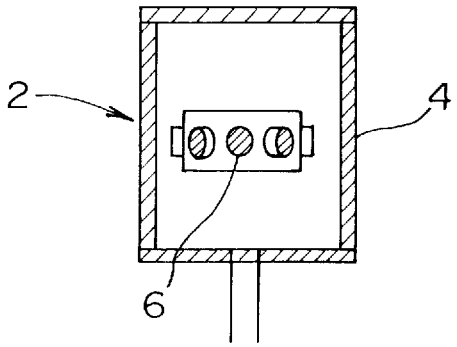
FIG. 3 is a longitudinal sectional view of the signal lamp of FIG. 1.
Figure 4:
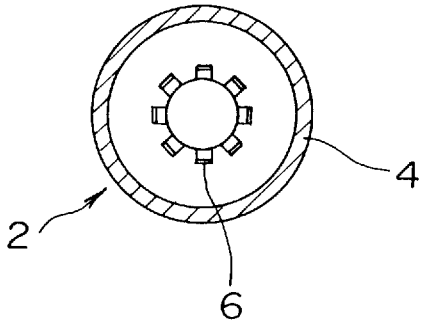
FIG. 4 is a cross-sectional view of the signal lamp of FIG. 1.

Referring to FIGS. 1 and 2, an indicator lamp 2 in a first embodiment of the present invention provides a plurality of color LEDs 6, i.e., light-emitting elements, arranged on the circumference of a disk, and a cylindrical lamp case 4, formed of milk-white paraglass, covering the color LEDs 6. When none of the LEDs 6 is turned on, the lamp case 4 looks milk-white. When the LEDs 6 are turned on, light is emitted by the LEDs 6 through the lamp case 4, so that the light indication of the signal lamp 2 is easily visible without being impaired by the reflection of ambient light from the surface of the lamp case 4. The LEDs 6 may be capable of emitting light of different wavelength to light up the lamp case 4 selectively in various colors.

Figure 5:
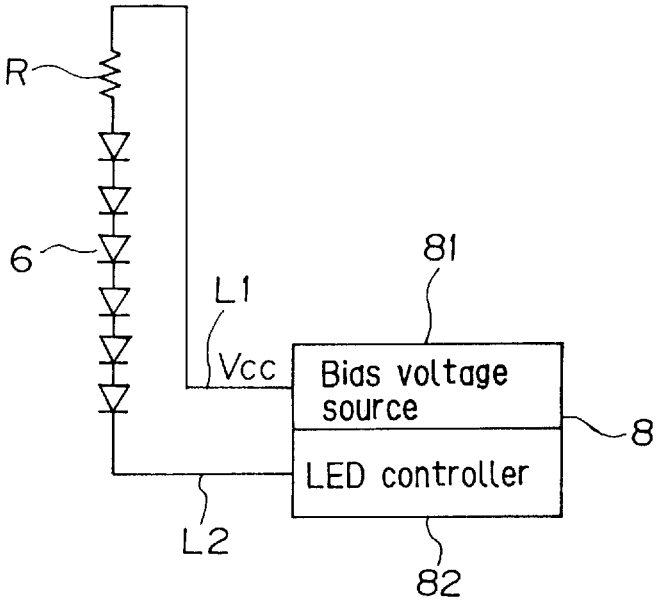
FIG. 5 is a circuit diagram of the circuit configuration of the signal lamp of FIG. 1.

Referring to FIG. 5, a signal lamp control circuit 8 included in the signal lamp 2 includes a bias voltage source 81 and an LED controller 82. A resistor R has one end connected to one end of series array of LEDs 6 and the other end connected by a line L1 to the bias voltage source 81. The other end of the series array of the LEDs is connected to the LED controller 82 by a line L2. The bias voltage source 81 applies a given bias voltage $V_{CC}$ to the line L1, and the LED controller 82 controls the voltage of the line L2 to turn the LEDs 6 on and off.

Figure 6:
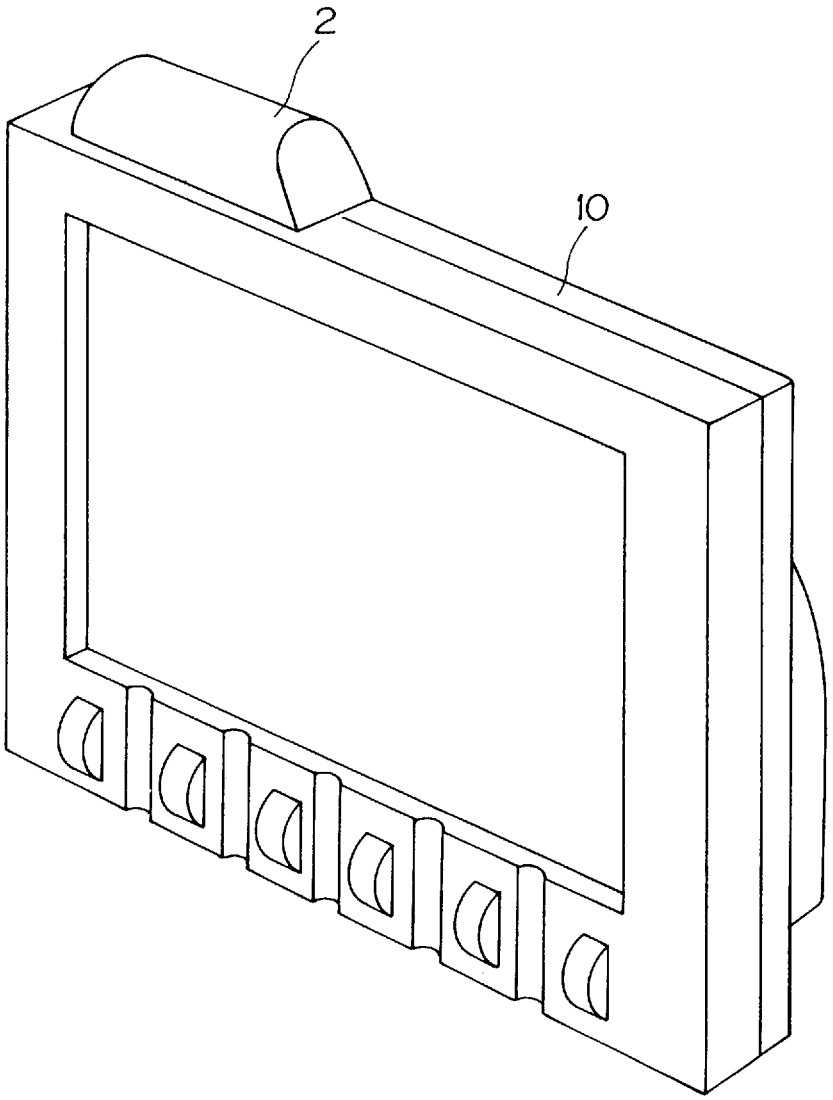
FIG. 6 is a perspective view of an indicator according to a second embodiment of the present invention.
Figure 7:
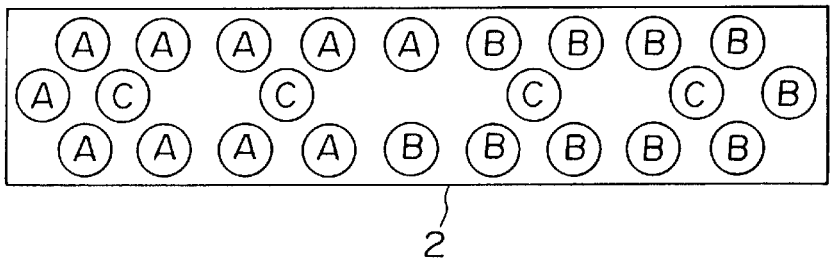
FIG. 7 is a diagrammatic view showing the arrangement of light-emitting elements of a signal lamp included in the indicator of FIG. 6.
Figure 8:
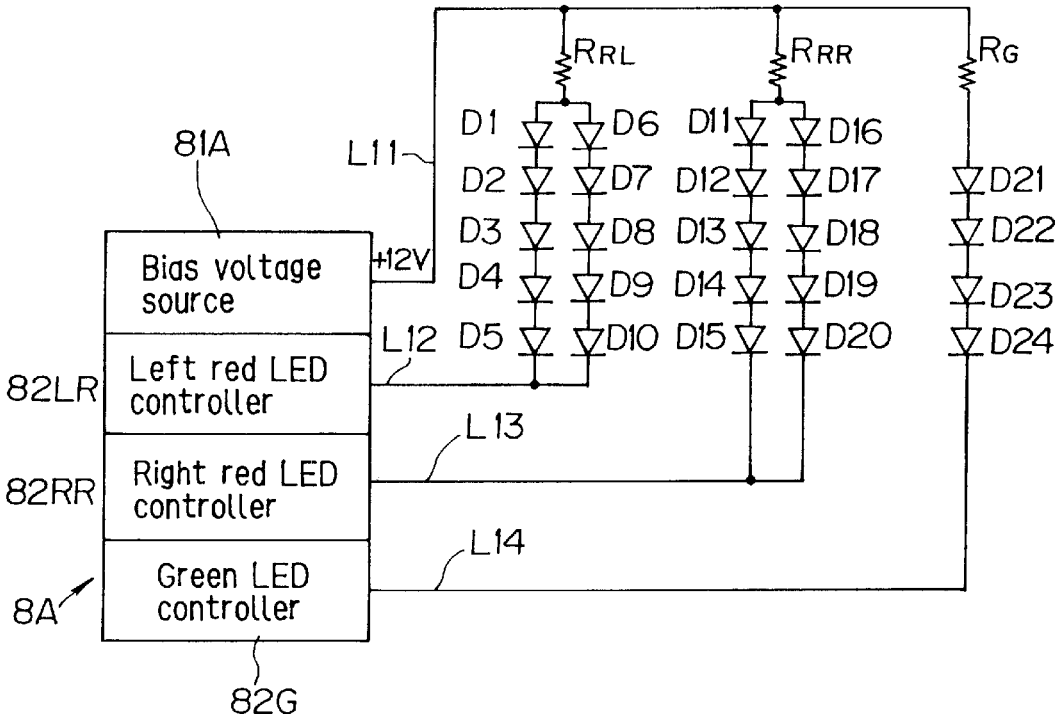
FIG. 8 is circuit diagram of a control circuit for controlling the light-emitting elements of FIG. 7.

FIG. 6 shows an indicator according to a second embodiment of the present invention, comprising a display unit 10 and a signal lamp 2 attached to the top of the display unit 10. As shown in FIGS. 7 and 8, the signal lamp 2 is provided with ten red LEDs D1 to D10 (marked "A" in FIG. 7) that emit red light, ten red LEDs D11 to D20 (marked "B" in FIG. 7) that emit red light and four green LEDs D21 to D24 (marked "C" in FIG. 7) that emit green light, which are arranged in a milk-white lamp case.

Referring to FIG. 8, the LEDs are controlled by a signal lamp control circuit 8A comprising a bias voltage source 81A, a left red LED controller 82LR, a right red LED controller 82RR and a green LED controller 82G. Resistors $R_{RL}$, $R_{RR}$ and $R_G$ are connected in parallel to a line L11 which is connected to the bias source voltage 81A.

Between the line L12, connected to the left red controller 82LR, and the resistor $R_{RL}$, 5 LEDs D1 to D5, connected to each other in series, are parallel-connected to another 5 LEDs D6 to D10, also connected to each other in series. Another two groups of 5 series-connected LEDs, D11 to D15 and D16 to D20, are parallel-connected to each other between the line L13, connected to the right red controller 82RR, and the resistor $R_{RR}$.

Five green series-connected LEDs D21 to D24 are connected between the resistor RG and a line L14, connected to the green LED controller 82G.

The bias voltage source 81A applies a specified bias voltage $V_{CC}$ of, for example, +12 V to the line L11. The left red LED controller 82LR controls the voltage on the line L12 to turn the left red LEDs D1 to D10 on and off, the right red LED controller 82RR controls the voltage on the line L13 to turn the left red LEDs D11 to D20 on and off, and the green LED controller 82G controls the voltage on the line L14 to turn the green LEDs D21 to D24 on and off.

The set of left red LEDs D1 to D10, the set of right red LEDs D11 to D20, and the set of green LEDs D21 to D24 are turned on and off individually or in combination to display a number of pieces of information by way of the signal lamp 2.

As can be seen in the example of FIGS. 7 and 8, where a plurality of light-emitting elements of different colors are incorporated, by activating only those light-emitting elements of the required color, a plurality of different colors can be indicated in one signal lamp. Also, if a number of LEDs of different colors are activated at once, yet another different color can be produced. In addition, as shown in FIGS. 7 and 8, since a number of different colors, i.e. many types of colors, are emitted from one signal lamp, compared to the prior art, the shape thereof takes up less space and is easier to design and install, and since there is less wiring, it is cheaper to manufacture.

Figure 9:
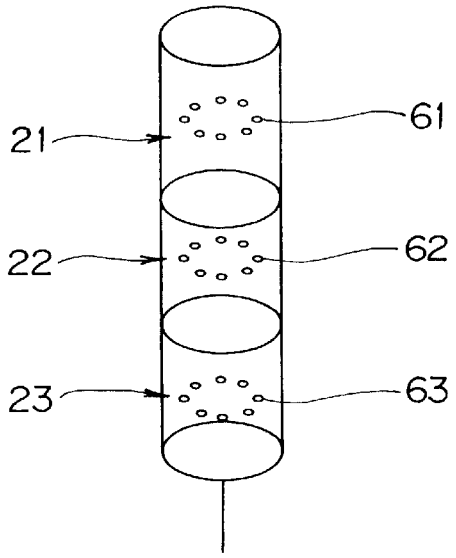
FIG. 9 is a schematic perspective view of an indicator with a number of stacked signal lamps, according to a third embodiment of the present invention.

Referring to FIG. 9, the indicator according to this embodiment of the present invention has an indicator including three signal lamps each comprising three signal lamp subunits 21, 22 and 23, aligned vertically. These signal lamp subunits 21, 22 and 23 are the same in construction as signal lamp 2 described above and shown in FIGS. 1 to 4, and consist of LEDs 61, LEDs 62 and LEDs 63, respectively, arranged on the circumference of a disk and covered by a milk-white lamp case. The LEDs 61, the LEDs 62 and the LEDs 63 may be of different colors, in order to display a number of pieces of information.

Figure 10:
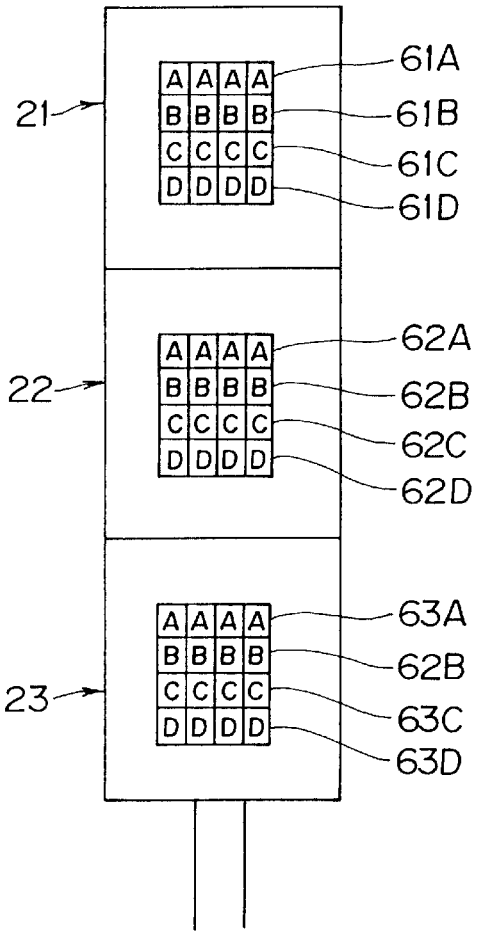
FIG. 10 is a diagrammatic view of an indicator with a number of stacked signal lamps each having a number of light-emitting elements which emit light of different colors, according to a fourth embodiment of the present invention.

Referring to FIG. 10, an indicator according to a fourth embodiment of the present invention has a signal lamp comprising three signal lamp subunits 21, 22 and 23 stacked vertically. The signal lamp subunits 21, 22 and 23 consist of LEDs 61A, 61B, 61C and 61D, LEDs 62A, 62B, 62C and 62D, and LEDs 63A, 63B, 63C and 63D, respectively, arranged on the circumference of a cylinder and covered by a milk-white lamp case. The LEDs 61A, 62A and 63A emit light of color A, the LEDs 61B, 62B and 63B emit light of color B, the LEDs 61C, 62C and 63C emit light of color C, and the LEDs 61D, 62D and 63D emit light of color D. The quantity of information that can be represented by the indicator of FIG. 10 is greater than the quantity of information that can be represented by the indicator of FIG. 9.

Figure 11:
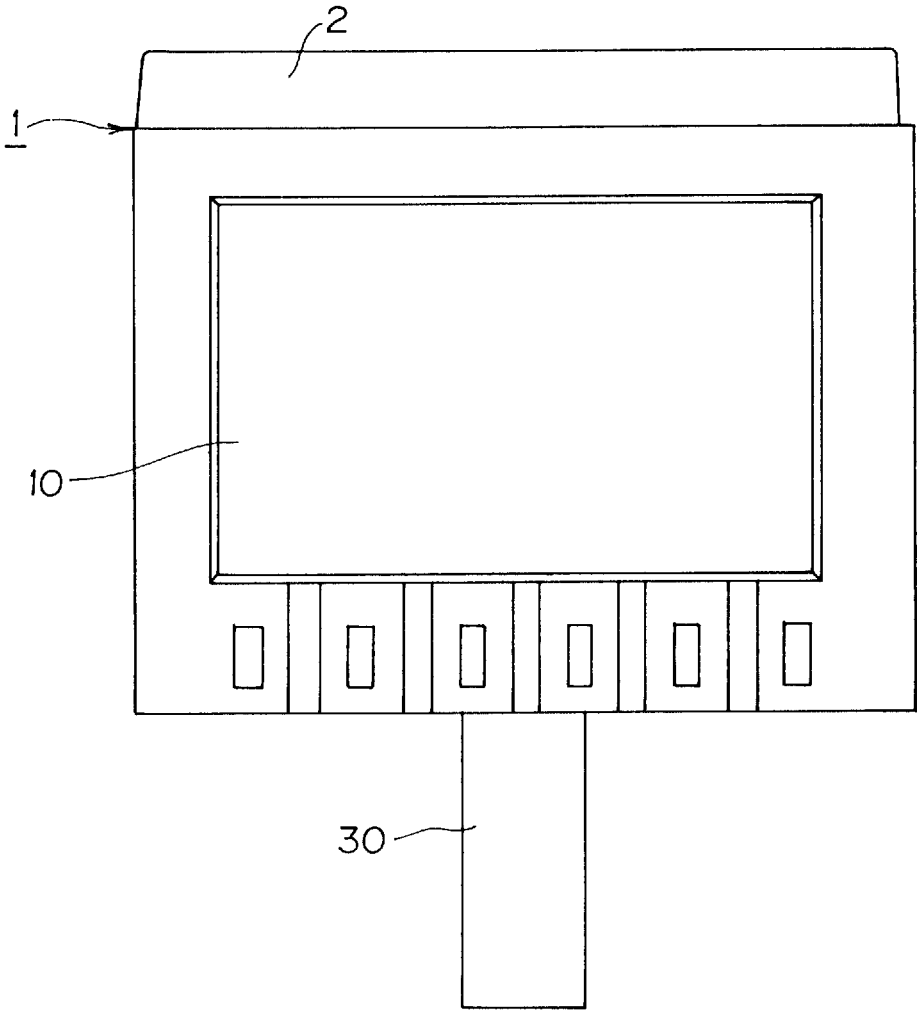
FIG. 11 is a front view of an indicator integrating a signal lamp and a display unit, according to a fifth embodiment of the present invention.
Figure 12:
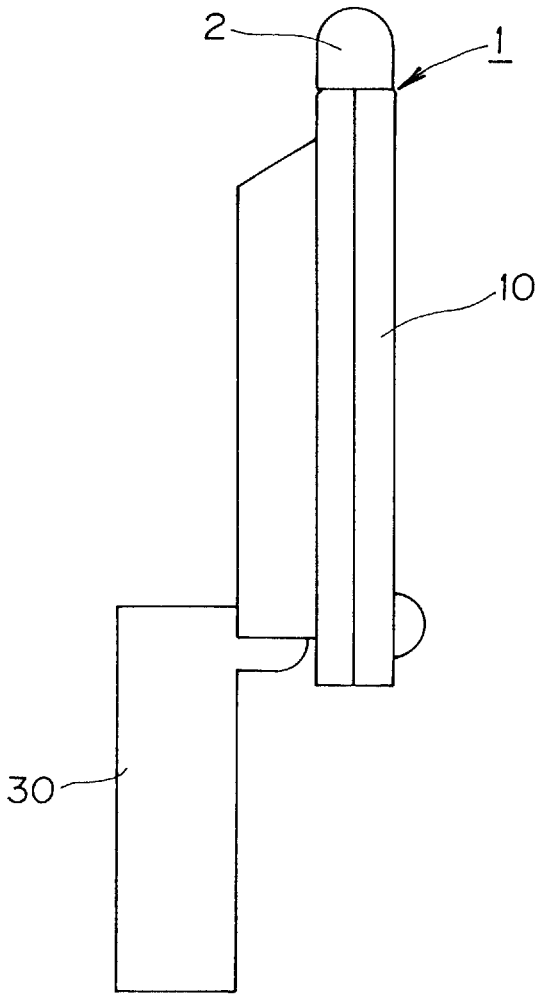
FIG. 12 is a side view of the indicator of FIG. 11.

Referring to FIGS. 11 and 12, an indicator 1 according to a fifth embodiment of the present invention comprises, in an integrated unit, a signal lamp 2 and a display unit 10. The signal lamp 2 comprises a number of LEDs and a milk-white lamp case. The display unit 10 is, for example, a liquid crystal display (LCD) of an electroluminescent display (ELD). The signal lamp 2 is attached to the top of the display unit 10 and the display unit 10 is supported on a pole 30. Thus, the indicator 1 has a compact construction.

Since the signal lamp 2 and the display unit 10 of the indicator 1 are combined in a single unit, the operating condition of the associated apparatus and information details can be provided simultaneously in one place, to enable the operator to read information simultaneously from both the signal lamp 2 and the display unit 10. The indicator 1 enables the operator to read the information about the operating condition of the associated apparatus displayed by the signal lamp 2 from a distance, and to enable the operator to read the details of the information on the display unit 10. Thus, the indicator 1 has a compact construction, requires simple wiring and can be manufactured at a reduced cost.

Figure 13:
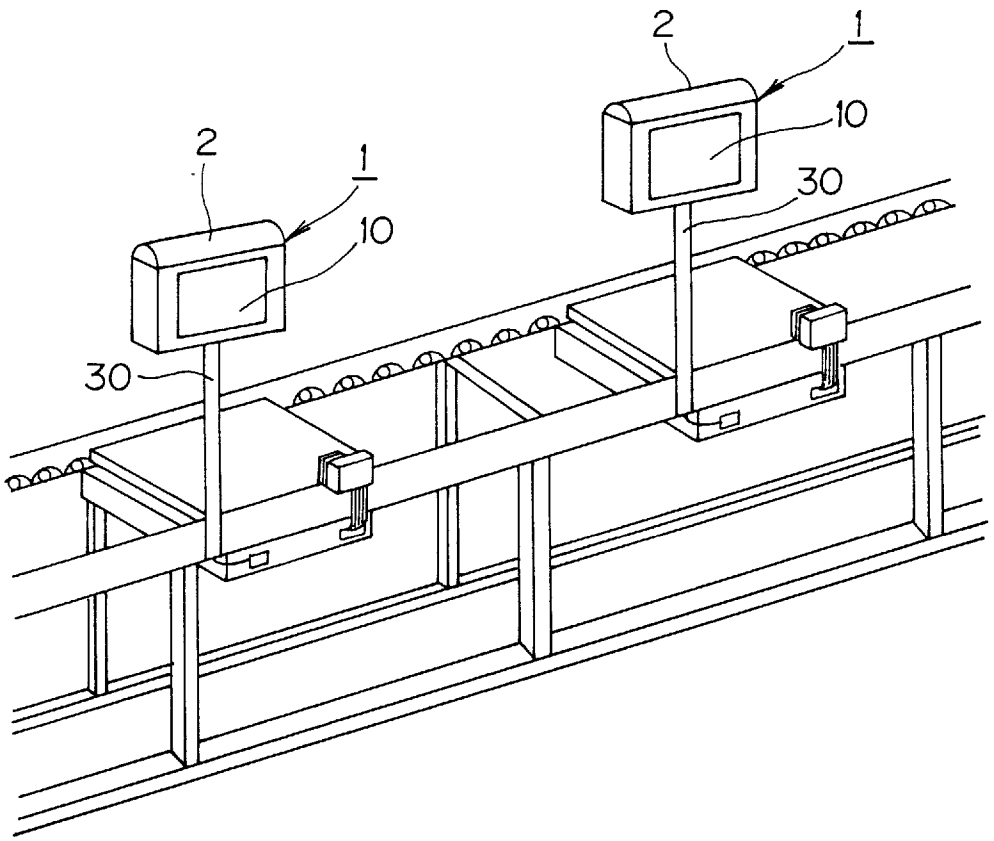
FIG. 13 is perspective view of a production line equipped with the indicator of FIG. 11.
Figure 14:
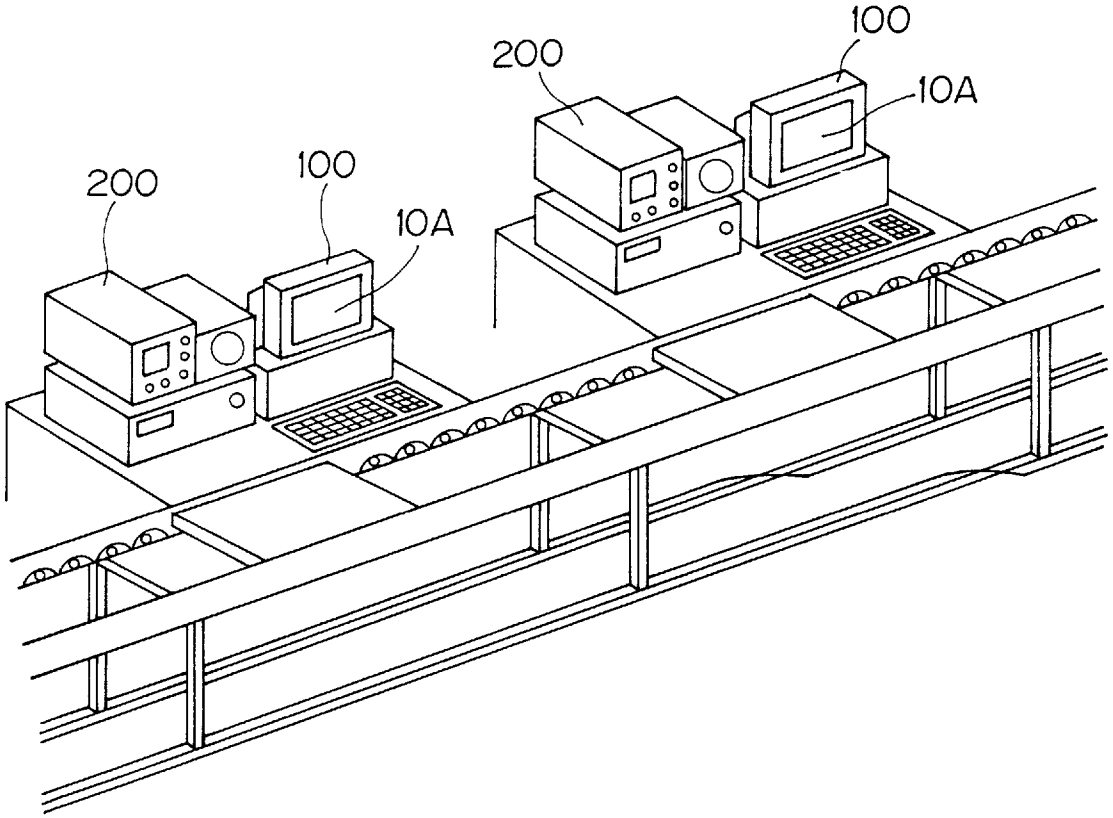
FIG. 14 is a perspective view of the same production line as that of FIG. 13, equipped with a conventional control system comprising computers and measuring apparatuses.

FIG. 13 shows a production line equipped with two display terminals 1 shown in FIGS. 11 and 12, and FIG. 14 shows a conventional production line as that shown in FIG. 13, provided with two computers 100 each having a display unit 10A, and two measuring apparatuses 200. Comparing FIGS. 13 and 14, it can be seen that information displayed by the signal lamp shown in FIG. 13 can be read from a place distant from the indicator 1 and details of the information can be seen on the display unit 10, whereas information displayed on the displays 10A of the computers 100 in FIG. 14 cannot be read from a distant place.

Figure 15:
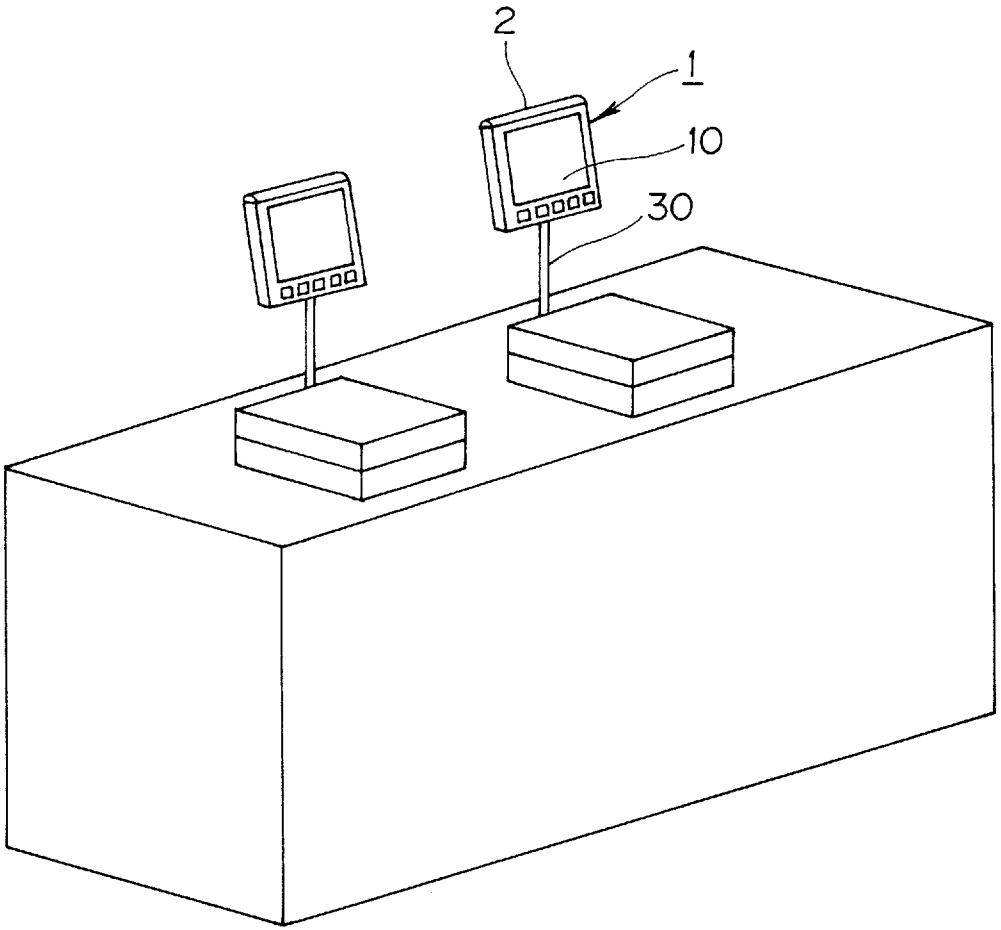
FIG. 15 is a perspective view of the indicator of FIG. 11, used as desk-top indicator.
Figure 16:
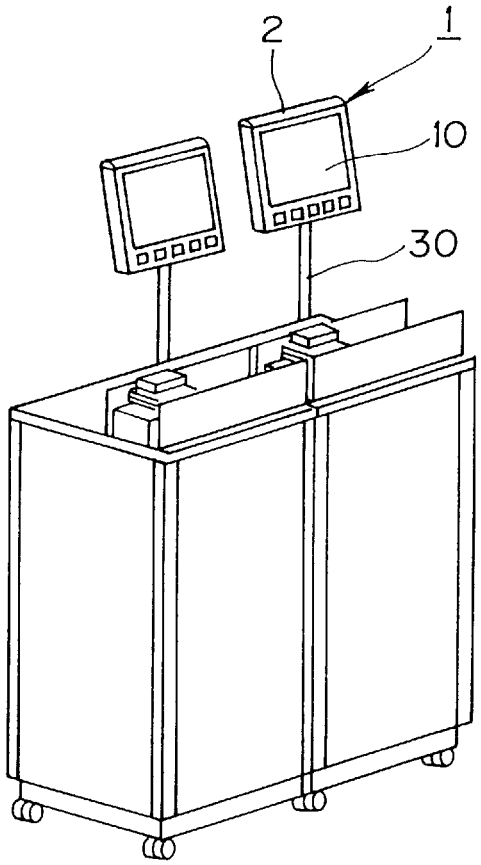
FIG. 16 is a perspective view of a production line station equipped with the indicator of FIG. 11.

The indicator 1 shown in FIGS. 11 and 12 can be applied in various situations, such as the desk-top system of FIG. 15 and the station shown in FIG. 16.

Figure 17:
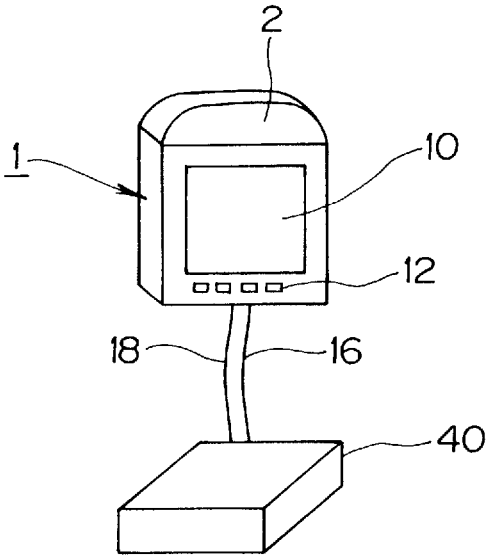
FIG. 17 is a schematic perspective view of a first display system, incorporating the indicator of FIG. 11, for use in conjunction with a production line.
Figure 18:
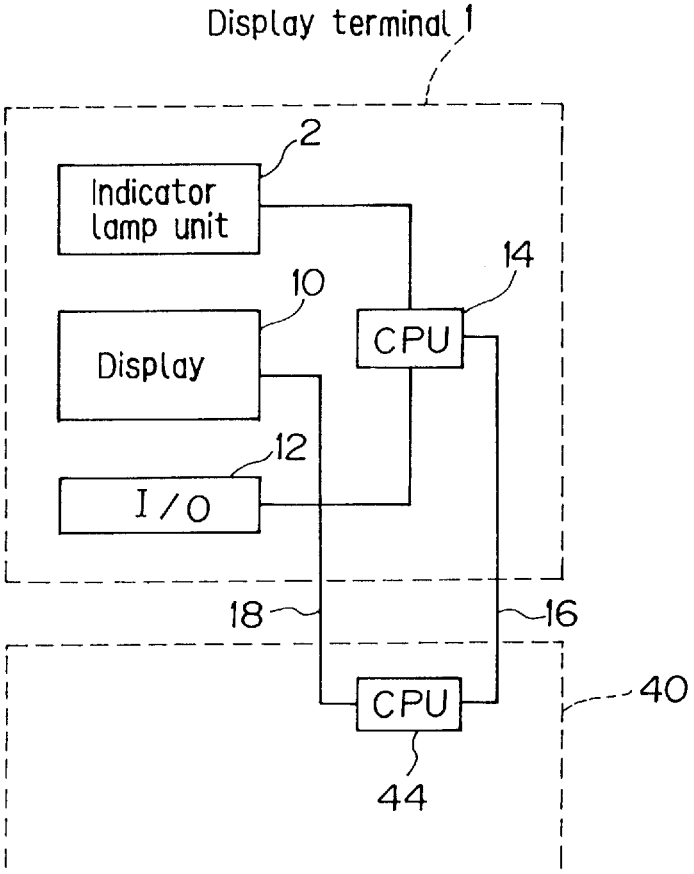
FIG. 18 is block diagram of a control system for controlling the indicator which is incorporated into the first display system of FIG. 17.

FIG. 17 shows a first display system comprising, in combination, the indicator 1 shows in FIGS. 11 and 12 and an information processing unit 40, for processing production line information, and FIG. 18 shows a control system for controlling the indicator 1 of this first arrangement. Referring to FIG. 17, indicator 1 comprises the integrated signal lamp 2 and display unit 10 shown in FIG. 11 and 12, and an I/O unit 12 provided with operating switches is located below the screen of the display unit 10 of the indicator 1. The indicator 1 is connected electrically to the information processing unit 40 by a signal cable 16 and a video signal cable or RGB signal cable 18.

Referring to FIG. 18, a CPU 44 included in the information processing unit 40 sends signals through a video signal cable or an RGB signal cable 18 to the display unit 10 of the indicator 1 to display detailed information, as to information processing results (for example information regarding defective products on a production line and production performance etc.), on the display unit 10, and controls a CPU 14 included in the indicator 1 via the signal cable 16. The CPU 14 controls the signal lamp 2 and the input unit 12 according to the input control signals. Since the CPU 44 directly controls the display unit 10, there is the advantage that the first display system can display detailed information immediately.

Figure 19:
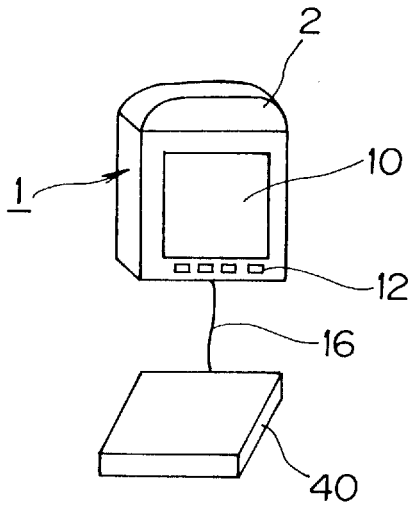
FIG. 19 is a schematic perspective view of a second information processing system, incorporating the indicator of FIG. 11, for use in conjunction with a production line.
Figure 20:
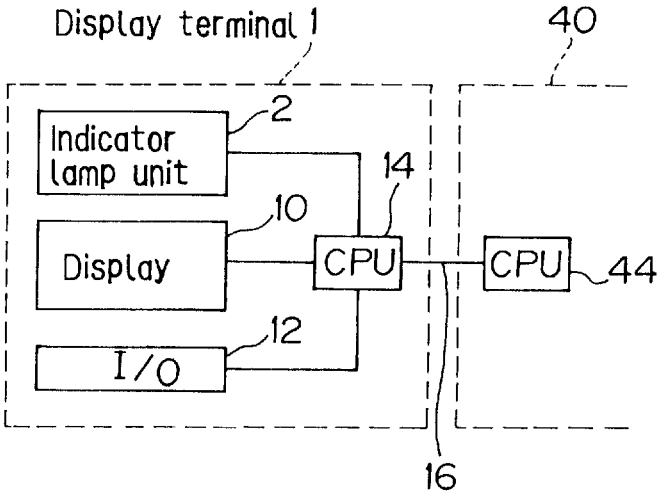
FIG. 20 is a block diagram of the control system of the display terminal of FIG. 19.

FIG. 19 shows a second display system comprising, in combination, the indicator 1 shown in FIGS. 11 and 12 and an information processing unit 40 for processing information about a production line, and FIG. 20 shows a control system for controlling the indicator 1 of this display system.

As shown in FIG. 20, the information processing unit 40 is connected to the indicator 1 by a signal cable 16; that is, a CPU 44 provided in the information processing unit 40 is connected to a CPU 14 provided in the indicator 1 by the signal cable 16. The CPU 44 transmits information processing results and control signals through the signal cable 16 to the CPU 14 of the indicator 1 to control the CPU 14. The CPU 14 is connected to the signal lamp 2, the display unit 10 and the input unit 12 by a video signal cable or RGB signal cable 18A. The CPU 14 displays detailed information, such as information about defective products and the production performance, on the display unit 10 and controls the signal lamp 2. Since the indicator 1 and the information processing unit 40 are interconnected only by the signal cable 16, the second display system has simplified wiring.

Figure 21:
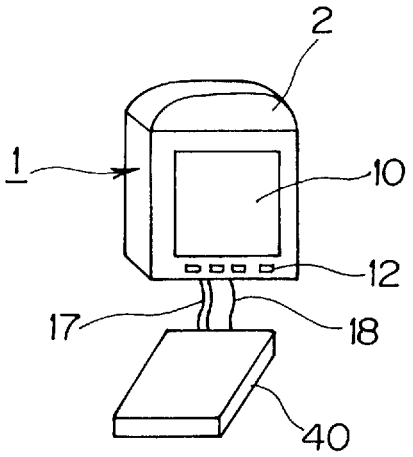
FIG. 21 is a schematic perspective view of a third information processing system, incorporating the indicator of FIG. 11, for use in conjunction with a production line.
Figure 22:
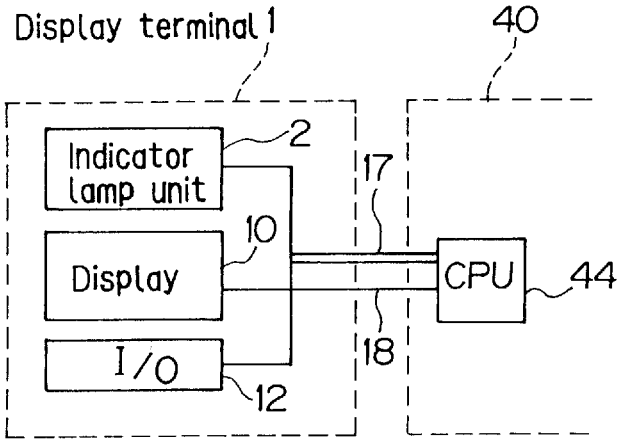
FIG. 22 is a block diagram of the control system of the indicator of FIG. 21.

FIG. 21 shows a third display system comprising, in combination, the indicator 1 shown in FIGS. 11 and 12, and an information processing unit 40 for processing information about a production line, and FIG. 22 shows a control system for controlling the indicator 1 of the third display system. The indicator 1 and the information processing unit 40 are interconnected by a flat cable 17 and a video or RGB signal cable 18.

As shown in FIG. 22, a CPU 44 included in the information processing unit 40 sends control signals through the video or RGB signal cable 18 directly to the display unit 10, to display detailed information about defective products production performance on the display unit 10, and sends control signals through the flat cable 17 directly to the signal lamp 2 and the I/O unit 12 to control the same. The employment of only the CPU 44 for controlling the indicator 1 enables this display system to be produced at reduced cost.

Although the invention has been described in its preferred forms with a certain degree of particularity, obviously many changes and variations are possible within the scope thereof. It is therefore to be understood that the present invention may be practiced otherwise than as specifically described herein without departing from the scope and spirit thereof.

What is claimed is:

1. An indicator comprising:

an indicator lamp having a lamp case which is light-transmissive to light emitted by at least one light-emitting element on one side of the lamp case, said lamp case being made from a material through which a light indication of said at least one light-emitting element is easily visible without being impaired by the reflection of ambient light from a surface on another side of the lamp case;

a signal lamp comprising said at least one light-emitting element located within said lamp case; and a display unit mutually integrated with said signal lamp for displaying information related to light emitted by said signal lamp.

2. An indicator according to claim 1, wherein said lamp case which covers said signal lamp is a milk-white color when the at least one light-emitting element is not emitting light, and transmits said light emitted by said at least one light-emitting element.

3. An indicator according to claim 2, wherein said signal lamp comprises a plurality of colored light-emitting elements for emitting light of various colors, said lamp case being transmissive to each of said various colors.

4. An indicator comprising:

a lamp case having a main body which is light-transmissive to light emitted from within said body, said main body being made from a material through which said light emitted from within said body is easily visible without being impaired by the reflection of ambient light from a surface on another side of said main body;

a signal lamp within said main body;

a display unit provided in said main body and integrated with said signal lamp;

a first control means provided in said main body, for controlling a display of said signal lamp and said display unit; and a second control means, for controlling said first control means, installed separately from said main body.

5. An indicator comprising:

a lamp case having a main body which is light-transmissive to light emitted from within said body, said main body being made from a material through which said light emitted from within said body is easily visible without being impaired by the reflection of ambient light from a surface on another side of said main body;

a signal lamp provided in said main body;

a display unit provided in said main body and integrated with said signal lamp;

a first control device, for controlling said display unit and said signal lamp; and a second control device installed separately from said main display unit for controlling said first control device.

6. An indicator comprising:

a lamp case having a main body which is light transmissive to light emitted from within said main body, said main body being made from a material through which said light emitted from within said body is easily visible without being impaired by the reflection of ambient light from a surface on another side of said main body;

a display unit provided in said main body;

a signal lamp provided in said main body and integrated with said display unit; and a processing means for controlling said display unit and said signal lamp, said processing means being installed separately from said main body.

7. An indicator as set forth in claim 1 wherein said lamp case is substantially cylindrical, and said indicator lamp comprises a plurality of light-emitting elements arranged on a circumference of a disk located within said cylindrical lamp case.

8. An indicator according to claim 7, wherein said lamp case which covers said signal lamp is a milk-white color when said plurality of light-emitting elements are not emitting light, and transmits said light emitted by said plurality of said light-emitting elements.

9. An indicator according to claim 7 wherein said plurality of light-emitting elements are LEDs capable of emitting light of different wavelengths to light said lamp case selectively in various colors.

10. An indicator according to claim 8 wherein said plurality of light-emitting elements are LEDs capable of emitting light of different wavelengths to light said lamp case selectively in various colors.

11. An indicator according to claim 1 further including a signal lamp control circuit included in the signal lamp and including a bias voltage source and a light-emitting element controller to control an on/off state of said at least one light-emitting element.

12. An indicator according to claim 11 wherein said signal lamp includes a plurality of light-emitting elements of at least a first color and a said second color, wherein said signal lamp control circuit controls an on/off state of said light-emitting elements individually or in combination.

13. An indicator according to claim 4, wherein said lamp case which covers said signal lamp is a milk-white color when at least one light-emitting element is not emitting light, and transmits said light emitted by said at least one light-emitting element.

14. An indicator according to claim 13, wherein said signal lamp comprises a plurality of colored light-emitting elements for emitting light of various colors, said lamp case being transmissive to each of said various colors.

15. An indicator according to claim 5, wherein said lamp case which covers said signal lamp is a milk-white color when at least one light-emitting element is not emitting light, and transmits said light emitted by said at least one light-emitting element.

16. An indicator according to claim 15, wherein said signal lamp comprises a plurality of colored light-emitting elements for emitting light of various colors, said lamp case being transmissive to each of said various colors.

17. An indicator according to claim 6, wherein said lamp case which covers said signal lamp is a milk-white color when at least one light-emitting element is not emitting light, and transmits said light emitted by said at least one light-emitting element.

18. An indicator according to claim 17, wherein said signal lamp comprises a plurality of colored light-emitting elements for emitting light of various colors, said lamp case being transmissive to each of said various colors.

* * * * *